US005107629A

United States Patent [19]

Boyd et al.

[11] Patent Number: 5,107,629

[45] Date of Patent: Apr. 28, 1992

[54] TEXTURING OF ACOUSTICAL MINERAL FIBERBOARD WITH WHEEL BLAST MACHINE

[75] Inventors: Alan L. Boyd, Seminole; Fred L. Migliorini, St. Petersburg, both of Fla.

[73] Assignee: The Celotex Corporation, Tampa, Fla.

[21] Appl. No.: 683,931

[22] Filed: Apr. 11, 1991

Related U.S. Application Data

[63] Continuation-in-part of Ser. No. 603,644, Oct. 26, 1990, abandoned, which is a continuation of Ser. No. 433,813, Nov. 9, 1989, abandoned.

[51] Int. Cl.[5] ..... B24B 1/00

[52] U.S. Cl. ..... 51/319; 51/317; 51/318; 51/326; 51/410; 51/418; 51/424; 51/431

[58] Field of Search ..... 51/420, 317, 318, 319, 51/326, 410, 417, 418, 424, 425, 426, 428, 431, 432

[56] References Cited

U.S. PATENT DOCUMENTS

| | | | |
|---|---|---|---|
| 2,338,591 | 1/1944 | Learmonth | 51/9 |
| 2,448,316 | 8/1948 | Lesavoy | 51/14 |
| 2,455,514 | 12/1948 | Mead | 51/8 |
| 2,777,256 | 1/1957 | Paasche | 51/14 |
| 2,952,100 | 9/1960 | Pelley | 51/14 |
| 2,993,309 | 7/1961 | Barnes et al. | 51/14 |
| 3,117,403 | 1/1964 | Jack et al. | 51/311 |
| 3,269,066 | 8/1966 | Straub | 51/319 |
| 3,405,481 | 10/1968 | Harper | 51/9 |
| 3,473,941 | 10/1969 | Hemphill | 117/5.5 |
| 3,540,155 | 11/1970 | Walker et al. | 51/9 |
| 3,597,928 | 7/1970 | Terentiev et al. | 264/87 |
| 3,731,432 | 5/1973 | Carpenter, Jr. | 51/426 |
| 4,001,977 | 1/1977 | Schrader | 51/15 R |
| 4,087,285 | 5/1978 | Kurtz | 106/52 |
| 4,093,754 | 6/1978 | Parsons | 427/259 |
| 4,174,591 | 11/1979 | Dupre et al. | 51/16 |
| 4,303,703 | 12/1981 | Maron | 427/272 |
| 4,476,655 | 10/1984 | Ansbaugh | 51/215 E |
| 4,566,230 | 1/1986 | Carpenter, Jr. | 51/420 |
| 4,597,928 | 7/1986 | Terentiev | 264/236 X |

FOREIGN PATENT DOCUMENTS

| | | | |
|---|---|---|---|
| 0045018 | 2/1983 | European Pat. Off. | 134/7 |

*Primary Examiner*—M. Rachuba
*Attorney, Agent, or Firm*—Charles W. Vanecek

[57] ABSTRACT

A method for texturing the surface of an acoustical fiberboard by utilizing a wheel blast machine. The fiberboard is conveyed through a housing wherein at least one first centrifugal blasting wheel throws abrasive particles at a portion of the fiberboard surface to abrade it. A blower provided in the housing removes spent abrasive particles thrown by the first wheel(s), and then at least one second centrifugal blasting wheel in the housing throws abrasive particles at the remaining untreated surface to complete the abrasion, whereby removal of the spent particles by the blower prevents masking of the surface and allows the formation of a pleasing and uniform pattern over the entire fiberboard surface.

16 Claims, 2 Drawing Sheets

TEXTURING OF ACOUSTICAL MINERAL FIBERBOARD WITH WHEEL BLAST MACHINE

This is a continuation-in-part of Application Ser. No. 07/603,644, filed Oct. 26, 1990, now abandoned, which is a continuation of Application Ser. No. 07/433,813, filed Nov. 9, 1989, now abandoned.

BACKGROUND OF THE INVENTION

1. Field of the Invention

This invention relates to a method and apparatus for producing an acoustical fiberboard, and more particularly is directed to the surface texturing of a mineral ceiling panel with a wheel blast machine.

2. Description of the Prior Art

Shaped products made from fibers and a binder, which are typically acoustical in nature, i.e., capable of attenuating sound, are well known in the art and are widely used today. Examples of such shaped products include ceiling panels and tiles, wall boards, screen dividers, construction panels, and the like. The conventional process for making these products involves use of a fourdrinier-type machine wherein an aqueous mixture comprising the fiber and binder is cast on a forming screen, and subsequently consolidated and dewatered. Normally, the formed board is passed to an oven for final drying.

A wide variety of processes have been employed in the past to produce a textured surface on these fiberboards, including cutting, routing, abrading, using adhesive inks or templates, etc. Frequently, it has been difficult to texture the boards without considerably weakening them or otherwise disadvantageously affecting them. A particular problem has been to carry out the texturing in such a way that a pleasing and uniform pattern is created on the board while the overall board properties are preserved. This problem is particularly exacerbated when the boards are extra wide and/or produced at high line speeds.

OBJECTS OF THE INVENTION

It is therefore an object of the present invention to provide an improved method and apparatus for decoratively texturing the surface of a fiberboard, whereby a pleasing and uniform pattern is formed without substantially diminishing the board's physical properties.

It is another object of the present invention to provide a method of decoratively texturing fiberboard, whereby a pleasing and uniform surface pattern is produced on extra wide boards being rapidly conveyed along a production line.

It is still another object of the present invention to provide a fine-textured fiberboard which is characterized by a combination of desirable physical properties, including good strength and sound-absorption properties and a highly decorative and uniform surface pattern.

Other objects and advantages of the present invention will become apparent to those skilled in the art when the instant disclosure is read in conjunction with the accompanying drawings.

SUMMARY OF THE INVENTION

The present invention provides a method for making an acoustic fiberboard, preferably a mineral ceiling panel, in which the surface of the board is textured by a wheel blast machine. The board product may be formed continuously by conventional wet processes wherein a water slurry of the board-forming ingredients is deposited upon a moving wire screen. The invention may also involve an operation whereby boards are formed in a cast process without water drainage from the product. After consolidation and drying, the board is abraded on either one of its two major surfaces.

The wheel blast machine comprises in sequence a first abrasive discharging means, a blower means and a second abrasive discharging means. As the dried board is conveyed through an abrading zone, abrasive particles are thrown by the first discharging means against the board to abrade its top surface. After thus impacting the surface of the board, spent abrasive particles collected on the board surface are blown therefrom by the blower means, thereby removing these particles from the path of the next collection of particles from the second discharging means.

More particularly, the present invention provides an apparatus for applying particulate material to the surface of a fiberboard to be provided with a decorative pattern comprising:

(a) a closed housing having entry and exit slots for the fiberboard;

(b) means for conveying the fiberboard to be treated through said housing in a horizontal position;

(c) a first abrasive discharging means disposed within the housing above the surface of the fiberboard to be treated for applying particulate material to the surface thereof;

(d) a blower means for removing spent particulate material collected on the surface of the fiberboard after discharge from the first abrasive discharging means; and (e) a second abrasive discharging means disposed within the housing above the surface of the fiberboard for further treatment of the surface with particulate material.

The first and second abrasive discharging means each advantageously comprise at least one centrifugal blasting wheel mounted in the roof of the housing to cause a portion of the fiberboard surface to be uniformly impacted. The second discharging means is located downstream along the production line from the first such means in order to abrade the remaining fiberboard surface untreated by said first means. Air blown from a device such as an air knife removes spent particulate material left on the surface after its abrasion by the first discharging means. This removal allows the production of a highly decorative and uniform pattern on the surface of the fiberboard.

Advantageously, to the upstream side of the air blower device and between this device and the first abrasive discharging means is a baffle which is mounted transversely to the longitudinally extending conveyor means and forms a complete partition across the housing except for a narrow rectangularly-shaped opening below the baffle's lower edge for conveyance of the fiberboard through the housing. A similar baffle is suitably mounted to the downstream side of the air blower device and between the device and the second abrasive discharging means to likewise partition the housing except for a bottom opening for fiberboard passage. These two partitions help to lessen interference by the abrasive thrown by the discharging means with the air cleaning operation.

DESCRIPTION OF THE DRAWINGS

The invention will now be described with reference to the accompanying drawings in which.

DETAILED DESCRIPTION OF THE INVENTION

Figure 1:
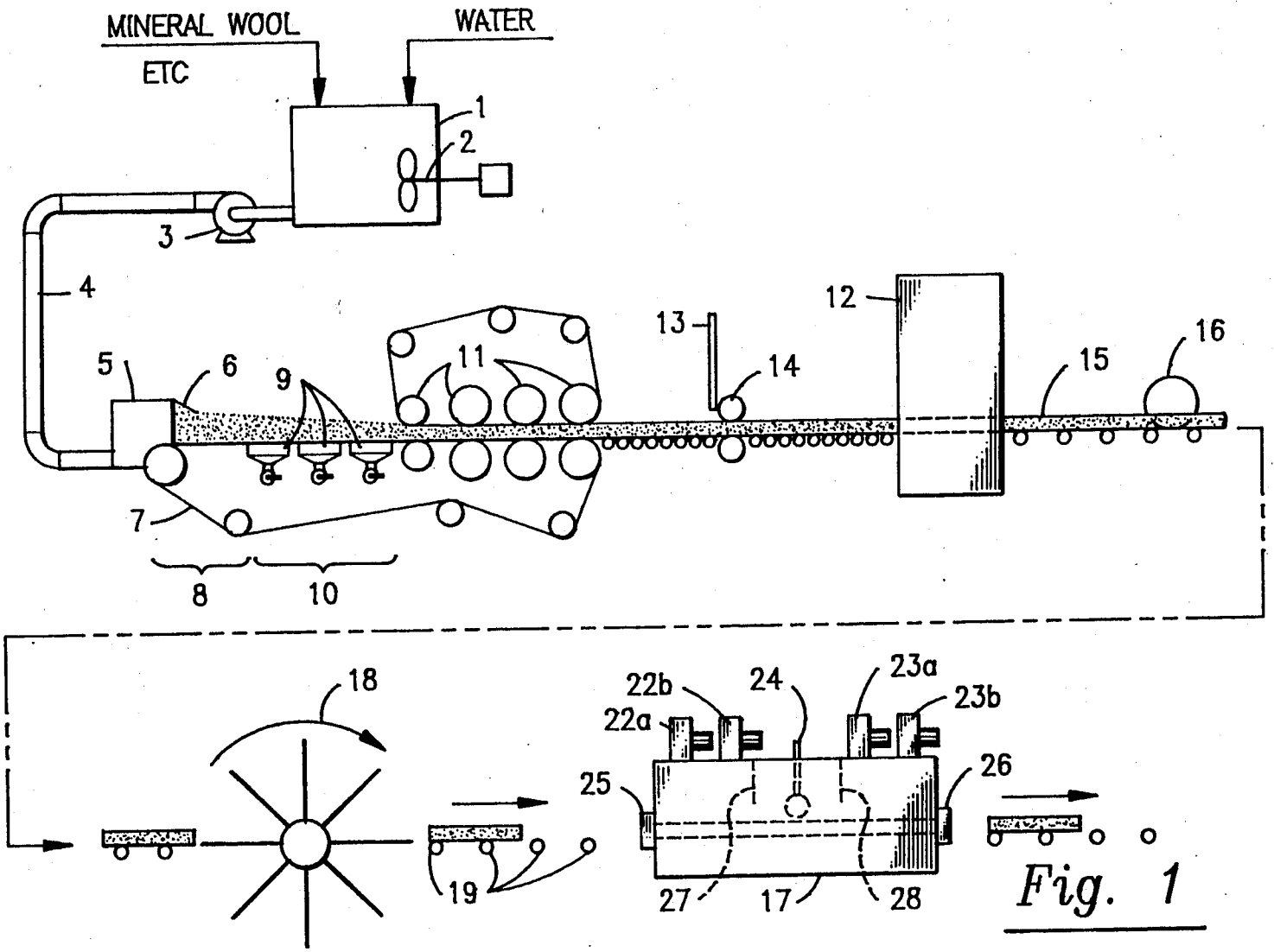
FIG. 1 a diagrammatic, side elevational view of an apparatus for carrying out the method of the present invention.

In carrying out the invention, a fiberboard sheet material, which may comprise inorganic and/or organic fibrous material and preferably consists of mineral fibers, a binder and the other board-forming ingredients, is produced in a conventional manner, such as on a wet board forming machine, e.g., a Fourdrinier or a cylinder machine. Referring now to FIG. 1, there is shown a machine chest 1 containing water to which the mineral fibers, such as conventionally felted mineral wool, are first added. Then the other ingredients, which advantageously consist of aqueous suspensions of perlite and optionally clay, of starch, and of paper, are added to the machine chest. The machine chest agitator 2 is suitably operated to keep the slurry stirred up so that the ingredients are uniformly distributed throughout the slurry. The solids content of the slurry may be from about 2 to 8 weight %.

In an advantageous embodiment of the invention, the fiberboard is produced from a slurry containing mineral fibers (e.g., mineral wool) which are nodulated during wet mixing of the slurry's ingredients. To bring about substantial formation of nodulated wool upon mixing of the slurry, the consistency must be sufficiently high, e.g., about 5 to 8, preferably 5.5 to 8, and more preferably 6 to 7.5 weight %. The formation of nodules of mineral fiber during mixing of the slurry may be brought about as described in U.S. Pat. application Ser. No. 210,446, filed Jun. 23, 1988, the disclosure of which application is hereby incorporated by reference. The rate and duration of agitation for forming an appropriate content of nodulated wool in the slurry can be readily determined through routine experimentation. Generally, the slurry is mixed for about 10 to 60 minutes by means of a rotary agitator (impeller) revolving at a rate of about 100 to 150 revolutions per minute. Alternatively, the mineral wool may be introduced to the slurry in the form of pellets of previously nodulated mineral wool.

After the slurry is agitated sufficiently to uniformly distribute the solids and, when appropriate, to nodulate the wool, the slurried composition is transferred by pump 3 through pipe 4 to head box 5. The slurry is subsequently deposited on Fourdrinier wire 7 through orifice 6 of head box 5. The first section 8 of the Fourdrinier wire permits free drainage of water from the material and further drainage is promoted by suction boxes 9 in section 10. As the slurry is brought in contact with the Fourdrinier machine and water of the slurry drains therefrom, a wet felted mat of the mineral fiber composition forms on the machine. The wet laid mat is dewatered by the Fourdrinier machine to a solids content of about 20 to 40 weight percent.

The partially dried material is then prepressed to a thickness of about 0.4 to 0.8 inch by a plurality of press rolls 11. It will be appreciated that a single set of press rolls could be employed if desired. After being pressed, the sheet product will generally have from about 60 to about 75% water. A coating may be applied to the pressed mat by means of feed-pipe 13 and coater 14.

After passing through press rolls 11, the wet mat is transferred into dryer 12. At the outlet of the dryer, there is obtained a board 15 having a moisture content of about 1.0%. The board is cut into smaller panels by saw arrangement 16. Dried boards having widths of 24 in. or more, e.g., 24 to 52 in., can be formed for texturing by the wheel blast machine of the invention. The dried product can be subjected to any suitable conventional finishing apparatus, depending on the applications for which it is intended. Such apparatuses may include applicators for applying coatings to protect and/or decorate the product surface, such as bevel coaters, finish spray coaters, printers, multi-color decorative coaters, and the like, and further drying equipment.

A fine-textured appearance is created on one of the two major surfaces of the dried board by the wheel blaster 17 of the invention. The board may be advantageously turned over by an inverter 18 to present the smooth screen side for surface treatment. The board is continuously passed by suitable conveyor means (e.g., conveyor rollers 19) through the wheel blast machine located on the production line. The housing 20 of the machine has inlet and outlet openings 25 and 26 for the board. The process can be run at a line speed of up to 200 lineal feet per minute. However, for optimum pattern uniformity, the line speed through the wheel blast machine generally should be about 150–180 lfpm. It is, of course, understood that the speed of the line can be readily adjusted so that the entire board surface will be uniformly subjected to the action of the abrasive spray from the wheel blaster. Even at quite high line speeds, the present invention makes it possible to produce pleasing and uniform patterns on boards which are much wider than conventionally textured boards. Whereas a typical width of a conventionally textured board is about 2 ft., boards having widths up to 52 in. or more can be readily textured in accordance with the present invention.

Figure 2:
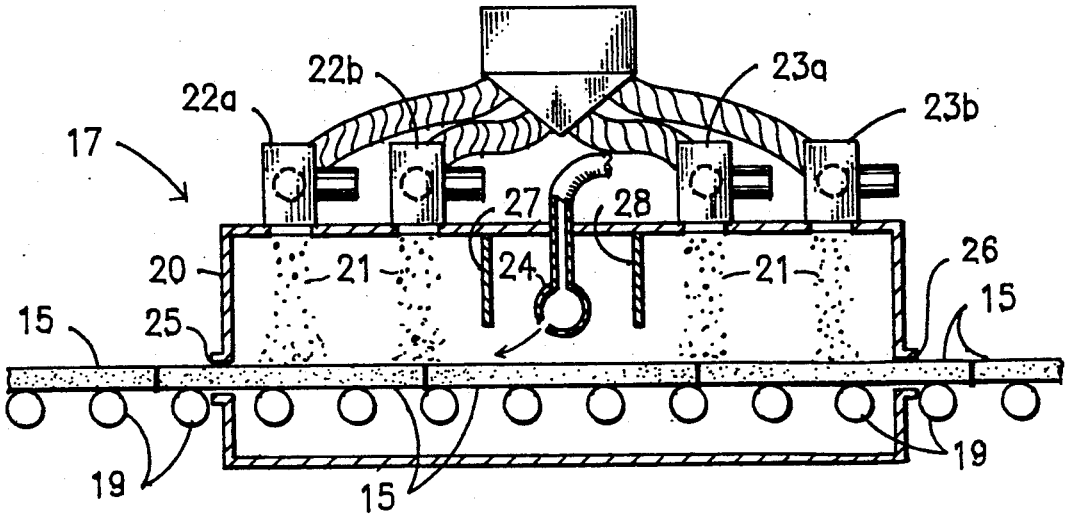
FIG. 2 is an enlarged cross-sectional view of the wheel blast machine shown in FIG. 1.
Figure 3:
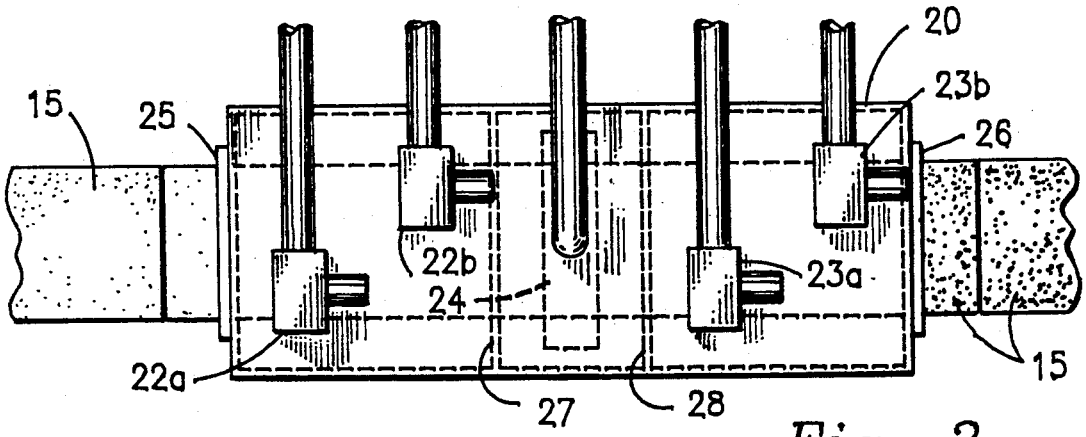
FIG. 3 is an enlarged top view of the wheel blast machine shown in FIG. 2, with certain parts being broken away for clarity.

Referring now to FIGS. 2 and 3, it will be seen that conveyor rollers 19 carry fibrous board 15 through the housing 20 of the wheel blast machine to abrade and thereby decoratively texture the board surface with abrasive material 21 propelled by first abrasive discharging means 22. The first abrasive discharging means advantageously comprises one or more roof mounted centrifugal blasting wheels 22 located within the blasting chamber directly above the conveyor means for directing the abrasive material downwardly upon the board as it passes through the chamber. When more than one blasting wheel is employed, such as the two shown in FIGS. 2 and 3, the wheels $22^a$, $22^b$ preferably are staggered in a longitudinally spaced apart relation and in a laterally spaced apart relation to cause the top surface of the board to be uniformly impacted by the abrasive particles centrifugally thrown by the wheels, preferably at an acute angle with respect to said board surface. The desired effect of the spacing is that abrasive thrown by the first wheel onto the board will ricochet without passing through the path of abrasive particles thrown by the next wheel thereby to minimize interferences with the particles thrown at the surfaces of the boards and also to avoid undesirable cushioning effects. Wheels $22^a$, $22^b$ are advantageously located so as to abrade the outer edges of the board.

The machine includes a second abrasive discharging means located within the blasting chamber downstream from the first such means. The second abrasive discharging means advantageously comprises one or more roof mounted centrifugal wheels 23 (two shown in FIGS. 2 and 3) similarly spaced for uniform treatment and texturing of the board surface. Wheels $23^a$, $23^b$ are suitably mounted to treat the interior portion of the board. The throwing wheels may be of conventional type described in the art, and can be obtained from Wheelabrator-Frye, Inc.

The surface-treating material 21 may be any abrasive capable of texturing the surface of the board. Both "heavy" abrasives (e.g., metal grit or shot) and "light" abrasives, which are of softer materials than the former type, may be used. "Light" abrasives include such items as glass shot, plastics, walnut shells, pecan shells, corn husks, peach pits, etc. Typically, the surface abrasion removes about 0.01–0.04, preferably 0.025–0.035, inch of the board surface in producing the desired look. Depending on factors such as the type of abrasive and board being treated as well as the spatial relationship of the wheels and board, the wheels can be operated at various speeds, such as from about 1800 to 3600 rpm.

Abrasive granules thrown by the first discharging means against the upper surface of board 15 rebound therefrom and collect inside cabinet 20 and disadvantageously on the board surface. If this spent blast medium is not removed from the surface of the board prior to the surface's exposure to another discharging means, an unacceptable condition known as "masking" occurs. This phenomenon results from blast medium covering the surface of the board and then being hit by subsequently thrown blast medium. The effect is lower relative abrasion from the second discharging means and, even when abrasion is evident, the character of the abrasion changes such that the texture of the masked area appears different from surrounding areas when painted, presenting an undesirably variable appearance.

Figure 4:
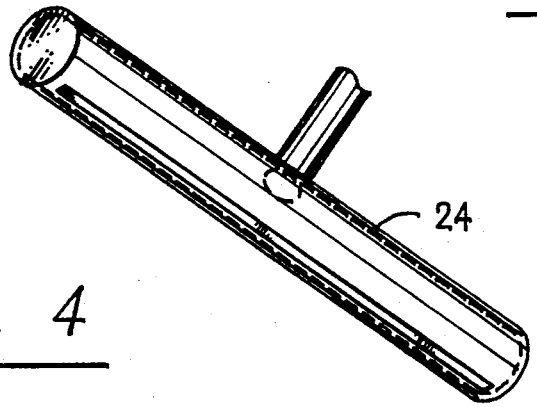
FIG. 4 is an enlarged perspective view of an air knife for removing abrasive particles.

A blower means disposed between the first and second abrasive discharging means removes from the board surface the spent abrasive particles thrown by the former means before exposure of the surface to the second abrasive discharging means. The blower means advantageously comprises a roof mounted device which supplies air under pressure to blow the spent abrasive off the board surface. As illustrated in FIGS. 2 to 4, air under pressure is directed from a suitable source, not shown, to a manifold 24, whereby air is directed downwardly at an angle of less than 90 to gently sweep the abrasive material from the surface. The air manifold may, for example, consist of a compressed air knife or a manifold connected to a centrifugal blower. In a preferred embodiment, the air is directed angularly downwardly onto the fiberboard to blow the abrasive particles laterally outwardly from its surface whereby the particles are displaced laterally beyond the board where they can settle downwardly for return by any suitable means to the chamber supplying the blast wheels to again be used. An especially suitable device for supplying air is the FIG. 4 embodiment comprising an elongated pipe 24 having a slit and mounted in housing 20 to extend above the production line and from side to side thereof.

As shown in FIGS. 1 to 3, baffles or partitions 27 and 28, in a generally parallel configuration, suitably are rigidly mounted on the roof of cabinet 20 and located to either side of blower device 24. The baffles help to reduce interference between the abrasive thrown by the first and second discharging means. They also help to lessen interference between the abrasive thrown by the discharging means and the cleaning operation of the intervening blower means. Each baffle suitably comprises a metal plate which extends downwardly from the roof and laterally from side to side of the cabinet, with its lower horizontal edge spaced a short distance above the open channel for the conveyor line extending from entrance 25 to exit 26 across the bottom of housing 20.

A final blow-off device, not shown, is located within housing 20 to remove residual abrasive material before conventional finishing of the boards.

From the above description it is seen that the present invention provides a method and apparatus whereby fiberboard surfaces may be rapidly and economically textured. In addition, the invention is seen to provide a method and apparatus for texturing fiberboard with abrasive particles by which method and apparatus the surface of the fiberboard may be uniformly and decoratively abraded without complications from spent abrasive on the board surface. The previous practice of removing spent abrasive from a treated surface by employing wipers made of rubber or similar material would be unacceptable. The dragging of these wipers across the abraded surface to scrape off used blast medium would leave marks on the fiberboard and result in product rejects.

The present invention is further illustrated by the following example in which all percentages are by weight.

EXAMPLE

This example illustrates with reference to the drawings the production of textured fiberboard in accordance with the present invention.

The formulation utilized in manufacturing the product consists of the following ingredients in the listed percentages by weight:

| Ingredient | % |
|---|---|
| Mineral Wool | 65.0 |
| Perlite | 21.5 |
| Newsprint | 4.0 |
| Starch | 9.5 |
| Retention Aid | 0.05 |

The ingredients were diluted with water to form a slurry in machine chest 1. Wet mixing of the slurry, which had a stock consistency of 7 wt. %, nodulated the mineral wool. The slurry was transformed to head box 5 and next deposited on Fourdrinier wire 7. The slurry was dewatered in a conventional manner on the Fourdrinier machine to form a wet felt or mat of interlocked fibers. The partially dewatered fibrous mat was next passed through a press section comprising pressing rolls 11, which densified the mat and provided a wet mat of uniform thickness (about one inch) with a moisture content of about 65%. After leaving the press section, the wet mat was conveyed to dryer 12.

After being dried, the board product was subjected to various conventional finishing steps, which included cutting into appropriate sizes and cleaning. After being flipped over by inverter 18, the board product was then abraded on the screen side by wheel blaster 17 and this side was coated to produce textured fiberboards of the invention.

Texturing of the boards was accomplished under the following conditions:

| | |
|---|---|
| Line Speed | 160 lfpm |
| Wheel Speed | 2400–2600 rpm |
| Wheel Load | 18 ± 1 amps |
| Board Thickness | 0.030"–0.040" |
| Removal | |

Board products made in accordance with the foregoing procedure had the following average physical properties:

| | |
|---|---|
| Thickness, in. | 0.700–0.750 |
| Density, lb/cu. ft. | 14.0–15.5 |
| Transverse | 19.0–25.0 |
| Strength, lb | |
| NRC | .60–.70 |

We claim:

1. A method of decoratively texturing the surface of an unmasked fiberboard which comprises:

(a) conveying the fiberboard in a horizontal position through a closed housing having entry and exit slots for the fiberboard, and (b) decoratively texturing the top surface of the fiberboard while the fiberboard is within the housing by:

(i) discharging particulate material downwardly against a region of the surface of the fiberboard to abrade the surface, a portion of the spent particulate material thereby being deposited on the surface of the fiberboard, (ii) blowing the spent particulate material off the surface, and (iii) discharging additional particulate material downwardly against the surface to complete the abrasion, whereby removal of the spent particulate material from the first discharge prevents masking of the surface and contributes to the formation of a decorative and uniform pattern over the entire fiberboard surface.

2. The method of claim 1 wherein the spent particulate material is blown off the surface of the fiberboard by air directed angularly downwardly onto the fiberboard.

3. The method of claim 1 wherein the fiberboard is conveyed through the housing at a speed of about 150 to 180 lineal feet per minute.

4. The method of claim 3 wherein the fiberboard has a width of about 24 inches to 52 inches.

5. The method of claim 1 wherein the particulate material in step (b)(i) is thrown by at least one first centrifugal blasting wheel mounted in the roof of the housing to cause a portion of the surface to be uniformly impacted, and the particulate material in step (b)(iii) is thrown by at least one second centrifugal blasting wheel mounted in the roof of the housing downstream from the first wheel or wheels to cause the remaining untreated surface to be uniformly impacted.

6. The method of claim 5 wherein the spent particulate material in step (b)(ii) is blown off the surface by a blower means mounted in the roof of the housing and located between two baffles mounted in the roof of the housing, one baffle being located between the first centrifugal blasting wheel or wheels and the blower means and the other baffle being located between the blower means and the second centrifugal blasting wheel or wheels.

7. The method of claim 6 wherein the spent particulate material is blown off the surface of the fiberboard by air directed angularly downwardly onto the fiberboard.

8. The method of claim 7 wherein the fiberboard whose surface is to be textured is formed by a wet process comprising depositing a water slurry of the board-forming ingredients upon a moving wire screen for drainage therefrom of water to form a wet felt, and consolidating and drying the wet felt.

9. The method of claim 1 wherein the particulate material in step (b)(i) is thrown by a first pair of centrifugal blasting wheels mounted in the roof of the housing and staggered in a longitudinally spaced apart relation and in a laterally spaced apart relation to cause regions at the outer edges of the surface to be uniformly impacted, and the particulate material in step (b)(iii) is thrown by a second pair of centrifugal blasting wheels mounted in the roof of the housing downstream from the first pair and staggered in a longitudinally spaced apart relation and in a laterally spaced apart relation to cause the interior region of the surface to be uniformly impacted.

10. The method of claim 9 wherein the particulate material is a member selected from the group consisting of glass shot, plastics, metal shot or grit, walnut shells, pecan shells, corn husks, and peach pits.

11. The method of claim 9 wherein the spent particulate material in step (b)(ii) is blown off the surface by a blower means mounted in the roof of the housing and located between two baffles mounted in the roof of the housing, one baffle being located between the first pair of centrifugal blasting wheels and the blower means and the other baffle being located between the blower means and the second pair of centrifugal blasting wheels.

12. The method of claim 11 wherein the spent particulate material is blown off the surface of the fiberboard by air directed angularly downwardly onto the fiberboard.

13. The method of claim 12 wherein the air is directed angularly downwardly from an air knife.

14. The method of claim 12 wherein the air is directed angularly downwardly from an elongated pipe having a slit and mounted in the roof of the housing to extend above the production line and from side to side thereof.

15. The method of claim 12 wherein the fiberboard is conveyed through the housing at a speed of about 150 to 180 lineal feet per minute.

16. The method of claim 15 wherein the fiberboard has a width of about 24 inches to 52 inches.

* * * * *